United States Patent [19]

Maurer

[11] 4,136,407

[45] Jan. 30, 1979

[54] UNDER SPRAY ARRANGEMENT FOR TOILET BOWLS AND THE LIKE

[76] Inventor: Hans Maurer, Rietholzstrasse 4, Zollikerberg, Switzerland

[21] Appl. No.: 826,567

[22] Filed: Aug. 22, 1977

[30] Foreign Application Priority Data

Oct. 12, 1976 [DE] Fed. Rep. of Germany ..... 2646021

[51] Int. Cl.[2] ..... A47K 3/22

[52] U.S. Cl. ..... 4/7; 4/6

[58] Field of Search ..... 4/7, 6

[56] References Cited

U.S. PATENT DOCUMENTS 1,935,201 11/1933 Callejo ..... 4/7

3,594,826 7/1971 Maurer ..... 4/7

*Primary Examiner*—Henry K. Artis

*Attorney, Agent, or Firm*—Gordon W. Hueschen

[57] ABSTRACT

An under spray arrangement for toilet bowls and the like, comprising a tube or pipe which is displaceably arranged in a cylinder which can be charged with pressurized water and is movable against the restoring force of a spring arrangement from a rest position into a work position. This tube or pipe, in order to form a piston, is closed at one end and is sealed with respect to the inner wall of the cylinder by seal means bearing with pressure at the cylinder wall. In the work position the part of the space or compartment of the cylinder which contains the pressurized water is connected with the internal space of the tube by means of a channel surrounding the seal means.

9 Claims, 5 Drawing Figures

UNDER SPRAY ARRANGEMENT FOR TOILET BOWLS AND THE LIKE

BACKGROUND OF THE INVENTION

The present invention relates to a new and improved construction of an under spray arrangement for toilet bowls and the like, which serves to spray water under pressure to given parts of the body of a user of the toilet bowl for hygenic cleansing purposes.

With prior art toilet bowl devices equipped with a spray unit, upon placing into operation the spray unit, the tube or pipe formed as a piston and arranged to be lengthwise displaceable in a cylinder, which tube is equipped with a spray head, can be extended by means of a pressure force exerted thereon by the pressure of the water. When the tube or pipe is in its extended position, in other words in its work position water is then sprayed through the spray head against the parts of the body which are to be washed or cleansed. The water which is used for this purpose is conventional tap water of the structure or building housing the toilet facilities, this water being pressurized by a pump and heated by a heater. Following the washing operation hot air is blown against the parts of the body which were wetted by the water, in order to dry such body parts, whereafter there is accomplished the usual flushing of the bowl of the toilet.

Such type toilet bowl systems equipped with a spray device have been disclosed, for instance, in Swiss Pat. No. 345,312 and Swiss Pat. No. 471,292. The spray devices or units of such prior art patent have the spray tube or pipe which is constructed as a piston, upon initiation of the flushing action, shifted into the work position due to action of the pressurized water. The work position is fixed by a mechanical stop, and the water pressure overcomes the force of a return or restoring spring which acts in the opposite direction upon the spray tube or pipe. When the spray tube or pipe has assumed the work position, then the water pressure is increased. As a result, a spring-loaded valve arranged in the spray tube frees a passage through which the water can flow into the inner compartment or space of the spray tube and thus can flow to the spray head and be sprayed thereby.

Upon completion of the washing operation there is interrupted the infeed of water to the spray device or spray unit. Consequently, the spring-loaded valve arranged in the spray tube or pipe first closes under the action of its spring, and then the spray tube is moved back into its rest position within the cylinder due to the action of the restoring or return spring.

This arrangement which comprises two springs of different spring force is complicated in construction and possesses a great number of individual parts. In particular, in order to overcome the spring force acting upon the valve by means of the pressure of the water, it is necessary that the equipment possess an additional water pump, since the water pressure of the tap water is smaller than the spring pressure of the spring acting upon the valve. Additionally, the two springs of the arrangement must be carefully accommodated to one another to ensure for a disturbance-free operation thereof.

SUMMARY OF THE INVENTION

Hence, with the foregoing in mind, it is a primary object of the present invention to overcome the aforementioned drawbacks and limitations of the prior art constructions.

Another and more specific object of the present invention aims at the provision of a new and improved construction of an under spray arrangement for toilet bowls and the like, which is relatively simple in construction and design, extremely reliable in operation, not readily subject to malfunction or breakdown, and requires a minimum of maintenance and servicing.

The spray device of the invention is manifested by the features that the seal arrangement or seal means comprises two substantially ring-shaped sealing elements arranged in spaced relationship from one another. The tube or pipe section disposed between the sealing elements possesses a passage which penetrates the tube or pipe wall, this passage leading into the internal space or compartment of the tube. One of the sealing elements bears at the inner wall of the cylinder at a pressure which is smaller than the pressure with which the other sealing element bears at the inner wall of the cylinder.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
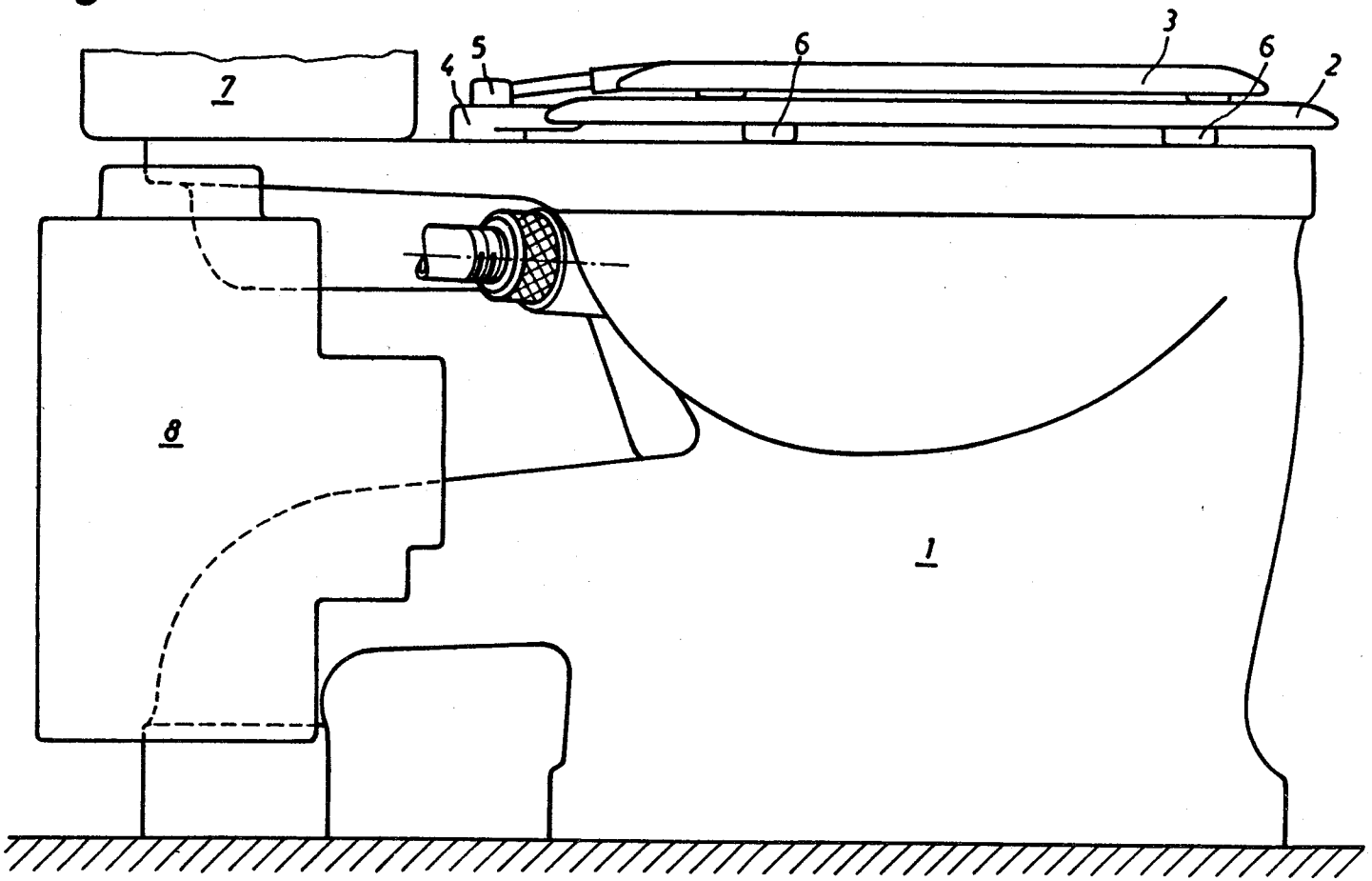
FIG. 1 is a side view of a toilet bowl system or toilet bowl equipped with a spray device or unit constructed according to the teachings of the present invention.
Figure 2:
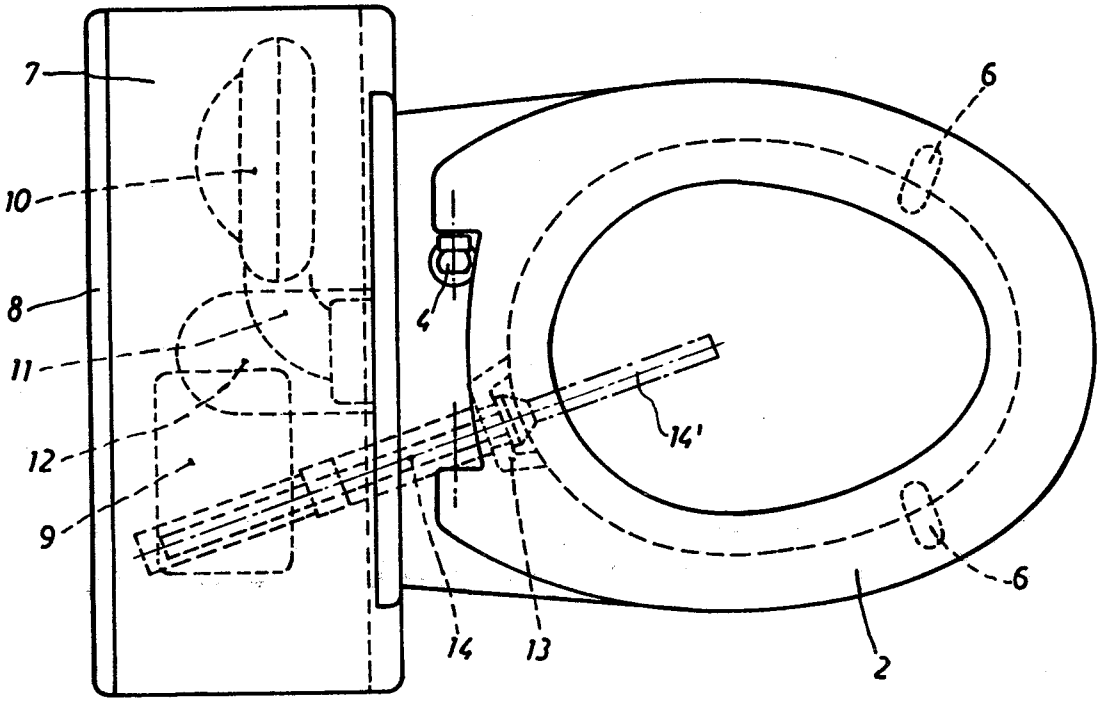
FIG. 2 is a top plan view of the toilet bowl together with the spray device, wherein the cover of the toilet bowl has been omitted to reveal internal structure.

The toilet bowl arrangement—also simply referred to as a toilet bowl—illustrated in the drawings will be seen to comprise a bowl 1 at which there are provided the standard hinge-connected or tiltable ring-shaped toilet seat 2 and cover 3. In FIG. 2 there has been omitted for clarity in illustration the cover 3. The ring-shaped toilet seat 2 and the cover 3 are each articulated by means of any suitable hinge device 4 and 5, respectively, with the toilet bowl 1. At the underside of the cover 3 there are arranged support elements 6 by means of which the cover 3 can be supported upon the upper edge of the bowl 1. At the rear side or end of the toilet bowl 1 there is arranged the flushing or toilet tank 7 and thereunder a container 8. The flushing tank 7 embodies the conventional actuating elements for flushing the bowl 1.

Continuing, and as best seen by referring to FIG. 2, a boiler 9 is arranged within the container 8. The boiler 9 serves to heat-up the water which is intended to wash the lower body parts of the user. Furthermore, there is provided a hot air blower 10 which supplies hot air by means of a channel 11 to the bowl 1 for the purpose of drying the washed body parts or portions. Finally, there is also shown in FIG. 2 the flushing water channel 12 for the standard flushing of the bowl 1.

Threadably connected with a bulge or protruding portion 13 at the bowl 1 is the actual spray device or spray unit. This spray device comprises a spray tube or pipe 14, wherein reference character 14 designates the rest or idle position thereof and reference character 14' its extended position constituting its work position. This spray unit has been shown in detail in FIGS. 3 and 4.

By referring thereto, it will be seen that such comprises a tube or pipe 15 functioning as a cylinder, and therefore, hereinafter conveniently designated as a cylinder tube or pipe 15. This cylinder tube 15 is assembled from two pipe or tube sections 16 and 17, these tube sections 16 and 17 being interconnected with one another by hard-soldering 18. The inner wall 19' of the tube or pipe sections 16 and 17 beneficially possess a covering or coating 49 formed of hard chromium and smoothly polished. The inlet end of the cylinder tube or pipe 15 is threadably connected with an end or terminal piece 20 provided with a blindhole bore 19, and at the threaded region 21 there is introduced a mass which seals against the effects of water. Protruding from the end piece 20 is a tubular section or element 22 which can be connected with a hot water hose leading from the boiler 9. This tubular or pipe section 22 opens into the infeed of the flushing water in the blindhole bore 19.

Figure 3:
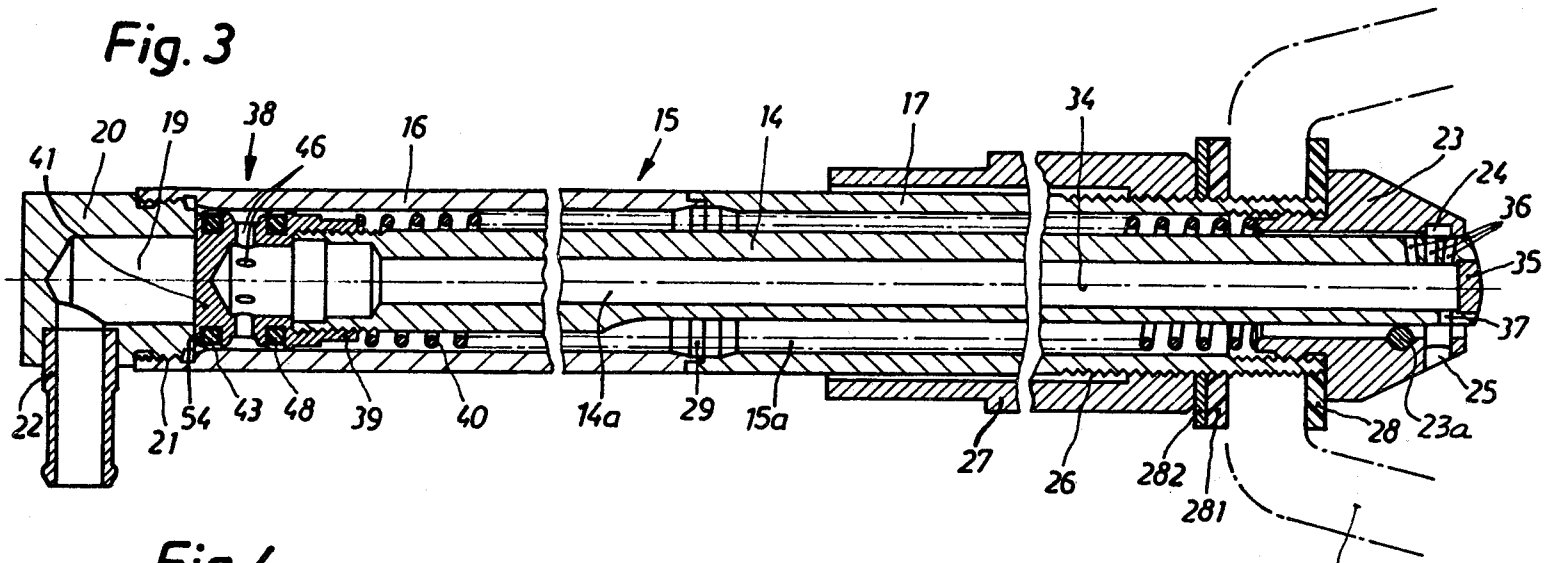
FIG. 3 is a longitudinal sectional view through the spray device used in the arrangement of FIG. 1.

At the opposite end the cylinder tube or pipe 15, i.e. the pipe section or portion 17 is threadably connected with a headpiece or element 23. This headpiece or element 23 possesses an internal peripheral groove 24 from which there extends towards the outside a discharge or outflow channel 25 in such a manner that, following completion of the washing operation, any water which is still in the spray tube or pipe 14 can drip into the bowl 1. Furthermore, the cylinder tube 15 and the pipe section or portion 17 possesses external threading 26 onto which there is threaded a nut member 27. Between the nut member 27 and the headpiece 23 there is arranged a first ring or ring member 28 and a second ring or ring member 281 formed of a soft material for preventing damage to the surface of the protruding portion 13 of the bowl 1. Furthermore, between the second ring 281 and the nut member 27 there is arranged an underlay or support disk 282. In the headpiece 23 there is furthermore arranged a bolt **23*a* which extends perpendicular to the lengthwise axis 34 of the tube 15, and upon which bolt there is supported the spray tube or pipe 14, as shown in FIG. 3**.

The cylinder tube or pipe 15 possesses, at the region where the pipe or tube portions 16 and 17 are interconnected with one another, a section 29 where the inner wall of the cylinder tube or pipe 15 coaxially widens, i.e. there is a reduction in the wall thickness of the cylinder tube or pipe 15.

Figure 4:
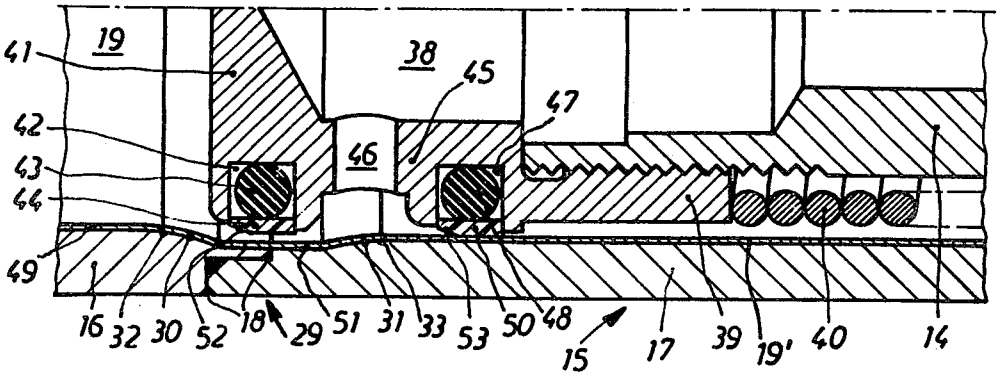
FIG. 4 is an enlarged longitudinal section view of part of the spray device, shown in FIG. 3 but this time positioned in its work position.
Figure 5:
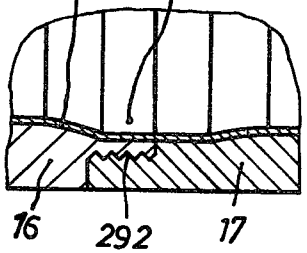
FIG. 5 shows a modification of the connection of the pipe or tube sections of the cylinder tube.

This circular ring-shaped section 29 possesses a floor 51 extending parallel to the wall of the cylinder tube or pipe 15 as best seen by referring to FIG. 4. The floor or bottom 51 is bounded at both sides by inclined extending flanks 30 and 31, each of which merge by means of a rounded portion 32 and 33, respectively, with the inner surface of the cylinder tube 15.

The spray tube 14 is closed at its front end by a stopper 35. Adjacent the stopper 35 there are arranged openings 36 penetrating through the tube wall and serving to produce jets of spray water i.e. spray jets, which, as will be recognized from the showing of FIG. 3, are upwardly directed. The opening 37 provided at the lower region of the tube wall is in flow communication with the discharge or outflow channel 25 serving to empty the inner space or compartment of the spray tube 14.

The rear end, or upstream end, of the spray tube 14 is threadably connected with a control element or member 38. This control element 38 possesses a shoulder portion 39. Between the shoulder portion or shoulder 39 and the headpiece 23 there is arranged a compression or pressure spring 40 which presses the spray tube 14 towards the left, in other words, into its rest or idle position. The control element 38 is closed by a plate 41. Formed in the plate 41 is a peripheral groove 42. Inserted into the peripheral groove 42 is a rubber ring 43. This rubber ring 43 is surrounded by a first sealing ring 44 formed of "TEFLON." The sealing ring 44 is guided in the peripheral groove 42, however protrudes past the peripheral surface of the plate or plate member 41. The sealing ring 44 is resiliently pressed by the rubber ring 43 against the inner wall of the tube section or portion 16, so that there is formed a sliding seal. Adjacent the plate 41 the wall portion 45 of the tubular-shaped control element 38 is interrupted by a number of holes or apertures 46 which are arranged along a peripheral line of the control element 38. These holes 46 form a passage leading to the internal space or compartment of the spray tube 14 which is located downstream of groove 42.

A further rubber ring 48 is inserted into a further peripheral groove 47 of the control element 38 of the spray tube 14. It will be apparent from the showing of the drawings, particularly FIG. 4, that the holes 46 forming the passage or passage means, viewed in the axial direction of the spray tube 14, are arranged between the peripheral groove 42 and the peripheral groove 47. The rubber ring 48 is surrounded by a second sealing ring 50 formed of "TEFLON," this sealing ring 50 being guided in the peripheral groove 47, however protruding past the peripheral surface of the control element 38. The sealing ring 50 is resiliently urged by the rubber ring 48 against the inner wall of the tubular section or portion 16, so that there is formed a sliding seal.

Groove 47 has a depth greater than that of groove 42 and the contact pressure of the rubber ring 43 of the plate 41 is greater than the contact pressure of the rubber ring 48. The spacing of the two "TEFLON"-rings 44 and 50 from one another is selected such that when the spray tube 14 is moved towards the right into the work or working position, at the region of the recess 29 which forms the inner peripheral groove 29, always at least one of the rings 44 and 50 bears upon the inner wall of the cylinder tube 15, i.e. either at the inner wall of the pipe section or portion 16 or at the inner wall of the pipe section or portion 17 for the faultless guiding of the spray tube 14.

From the showing of FIG. 4 it will be seen that the ring 44 possesses a section or portion 52 which extends at an inclination to the lengthwise axis 34 of the spray tube 14, in other words has a substantially truncated conical-shaped section 52, and the ring 50 possesses a section or portion 53 extending approximately parallel thereto. Both sections or portions 52 and 53 extend at an inclination towards the end or terminal piece 20. This construction ensures that when the spray tube 14 shifts from the work position 14' (FIG. 2) back into the rest position, the rings 44 and 50 slide, without abutment, over the flanks 30 and 31 of the recess 29. This is important because the restoring force of the compression spring 40 is small, this restoring force being exerted upon the spray tube or pipe 14. Such restoring or return force must be smaller than the water pressure of the tap water which is available, and which normally has a pressure in the order of magnitude of 2 atmospheres.

The spray device operates in the following manner: in the rest position it is located in the position illustrated in FIG. 3, and the plate 41 bears against a shoulder 54 of the end piece 20.

In order to initiate the spray operation the user actuates a not particularly illustrated starting element, for instance a push button or equivalent structure, which, if desired, can be safeguarded against unintentional actuation. The starting element causes flushing or washing water to flow through the boiler 9 and to enter the spray device at the tubular section 22, i.e. to first enter the blindhole bore 19 of the end piece 20. Consequently, a pressure is exerted upon the plate 41. Because the plate 41 bears against the shoulder 54 and the first sealing ring 44 is sealingly pressed by means of the rubber ring 43 against the inner wall of the tube or pipe section 16 of the cylinder tube 15, there is effective all of the water pressure upon the plate 41. This pressure is greater than the oppositely effective force of the spring 40. Consequently, the spray tube 14 is shifted towards the right of the showing of FIG. 3 into its work position. During such shifting or displacement the first sealing ring 44 prevents entry of water into the spray tube 14 and premature spraying thereof.

Once the spray tube or pipe 14 has reached the work position shown in FIG. 4, then there is formed a by-pass, in other words a by-pass channel or shunt about the plate 41, because in this position the sealing ring 43 is located at the recess 29. Consquently, the pressurized water flows into the inner space or compartment 14*a* of the spray tube 14 and out of the openings 36 forming the spray nozzle and also out of the opening 37. Hence, the spray tube 14 is continuously held by the water pressure in the work position. The contact force of the rubber ring 48 upon the second sealing ring 50 and thus its sealing capability is smaller than that of the rubber ring 43.

Hence, in the work position of the spray tube 14, a certain amount of leakage water flows into the substantially ring-shaped space or chamber 15*a* bounded by the outer wall or shell of the spray tube 14 and the inner wall or shell of the cylinder tube 15. This leakage water can escape through the opening 25 provided in the headpiece 23.

If for the completion of the washing operation the infeed of water to the pipe or tube section 22 of the spray device is interrupted, then the compression or pressure spring 40 acting upon the shoulder portion 39 returns the spray tube 14 back into its rest position. Any excessive amount of water, for instance the water which is present in the inner space or chamber 14*a* of the spray tube 14, thus flows through the opening 37 and especially the discharge or outflow channel 25 into the bowl 1.

While there are shown and described present preferred embodiments of the invention, it is to be distinctly understood that the invention is not limited thereto, but may be otherwise variously embodied and practiced within the scope of the following claims.

Accordingly, what is claimed is:

1. In an under spray arrangement for a toilet bowl, comprising:

a cylinder;

means for infeeding pressurized water to the cylinder;

tube means displaceably arranged in said cylinder;

spring means for exerting a restoring force upon said tube for moving said tube means from a work position into a rest position;

means closing the upstream end of said tube means in order to form a piston structure;

said cylinder having an inner wall;

sealing means for urging the piston structure with pressure against the inner wall of the cylinder and for sealing said piston structure with respect to said cylinder-inner wall;

said cylinder including a spatial region containing the pressurized water in the work position of said tube means;

annular channel means in said sealing means for flow communicationg the spatial portion of the cylinder with the inner space of said tube means;

said sealing means comprising two substantially ring-shaped sealing elements arranged in spaced relationship from one another, one on the upstream side and the other on the downstream side of said channel means;

said tube means including a tube section located between said sealing elements;

said tube section having passage means penetrating the the wall of said tube means and leading from said channel means into the inner space of said tube means; and by-pass means located at the work position of said sealing means for by-passing water from the spatial region of said cylinder into said channel means, the combination in which, the downstream sealing element bears at a pressure against the inner wall of the cylinder which is smaller than the pressure with which the upstream sealing element bears against the inner wall of the cylinder.

2. The under spray arrangement as defined in claim 1, wherein:

said by-pass means comprises a section of the inner wall of said cylinder which is coaxially widened; and wherein, in the work position of said tube means, both the upstream sealing element and said passage means are arranged at the region of the widened section and the downstream sealing element sealing a spatial region of the cylinder which does not contain any pressurized water.

3. The under spray arrangement as defined in claim 2, wherein:

each of the sealing elements possesses an elastically deformable support ring mounted in the wall of the tube means; and a slide ring having an adhesion-poor surface concentrically surrounding said support ring.

4. The under spray arrangement as defined in claim 3, wherein:

said slide ring possesses a substantially cylindrical section and, on the upstream side thereof, a further section having a substantially truncated cone-shaped jacket merging in one-piece with said cylindrical section;

said truncated cone-shaped jacket forming an an acute angle with the inner wall of said cylinder, thereby forming a ramp surface for said slide ring to ride up out of said widened section onto the inner surface of said cylinder in returning from the work position to the rest position.

5. The under spray arrangement as defined in claim 3, wherein:

the support ring is formed of an elastomeric material;

the slide ring comprises a plastic ring; and said support ring outwardly radially pre-biasing the slide ring.

6. The under spray arrangement as defined in claim 3, further including:

an annular groove provided in said tube means for each sealing element of such size that part of the slide ring protrudes past the groove and the remainder is engaged by the sides of said groove to hold said slide ring against lateral displacement.

7. The under spray arrangement as defined in claim 6, wherein:

the dimensions of the support ring of the upsteam sealing element substantially equal the dimensions of the support ring of the downstream sealing element in the non-tensioned state;

the annular groove associated with the downstream sealing element has a greater depth than the annular groove associated with the upstream sealing element; and the sections of the cylinder to both sides of the coaxially widened location possessing the same internal diameter.

8. The under spray arrangement as defined in claim 1, wherein:

said spring means comprises a compression spring, arranged in an annular space between the tube means and said cylinder and extending substantially coaxially thereto; and said spring has one end bearing against the downstream end of said cylinder and the other end bearing against the upstream end of said tube means.

9. The under spray arrangement as defined in claim 8, wherein:

in each position of the tube means, said sealing means operates to prevent any substanial passage of water from the space containing the pressurized water into the annular space containing the spring means.

* * * * *